US008894591B2

(12) United States Patent
Hiki

(10) Patent No.: US 8,894,591 B2
(45) Date of Patent: Nov. 25, 2014

(54) WALKING ASSISTANCE DEVICE

(75) Inventor: Yutaka Hiki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 483 days.

(21) Appl. No.: 13/314,848

(22) Filed: Dec. 8, 2011

(65) Prior Publication Data

US 2012/0157894 A1 Jun. 21, 2012

(30) Foreign Application Priority Data

Dec. 20, 2010 (JP) ..... 2010-283363

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 3/00*** | (2006.01) |

(52) U.S. Cl.

CPC ..... *A61H 1/024* (2013.01); *A61H 3/00* (2013.01); *A61H 2201/1633* (2013.01); *A61H 2201/1642* (2013.01); *A61H 2201/5007* (2013.01); *A61H 2201/5061* (2013.01)

USPC ..... 601/5; 601/33; 601/34; 601/35; 297/201

(58) Field of Classification Search

USPC ..... 601/5, 23, 33–36; 297/4, 201, 202; 602/23

See application file for complete search history.

(56) References Cited

U.S. PATENT DOCUMENTS

| | | | |
|---|---|---|---|
| 8,394,044 | B2 | 3/2013 | Ashihara et al. |
| 2010/0063424 | A1 | 3/2010 | Kudoh et al. |
| 2010/0069799 | A1 * | 3/2010 | Ashihara et al. ..... 601/34 |

FOREIGN PATENT DOCUMENTS

| | | |
|---|---|---|
| JP | 2006-224800 | 8/2006 |
| JP | 2007-054616 | 3/2007 |
| JP | 2008-048753 | 3/2008 |

* cited by examiner

*Primary Examiner* — Justine Yu
*Assistant Examiner* — Kathrynn Reilly
(74) *Attorney, Agent, or Firm* — Rankin, Hill & Clark LLP

(57) ABSTRACT

A walking assistance device includes a seating member configured to provide seating for a user to sit astride, and leg links connected to the seating member. The seating member includes: a supporting member configured to support the user sitting on the seating member from below the seating member; a movable member configured to contact an inguinal region of the user supported by the supporting member and to be movably supported by the supporting member; and at least one elastic member provided between the movable member and the supporting member and configured to be deformable in accordance with a force applied from the inguinal region of the user to the movable member.

10 Claims, 8 Drawing Sheets

WALKING ASSISTANCE DEVICE

CROSS REFERENCE TO RELATED APPLICATION

This application claims the foreign priority benefit under Title 35, United States Code, §119(a)-(d) of Japanese Patent Application No. 2010-283363 filed on Dec. 20, 2010 in the Japan Patent Office, the disclosure of which is herein incorporated by reference in its entirety.

BACKGROUND OF THE INVENTION

1. Technical Field

The present invention relates to a body weight support-type walking assistance device designed for a user to sit astride.

2. Description of the Related Art

For example, a conventional body weight support-type walking assistance device is disclosed in Japanese Laid-open Patent Application Publication No. 2008-48753. This walking assistance device includes a saddle configured to allow a user to sit thereon, leg links each extending downward from and swingably connected to the saddle to allow swing movements thereof in accordance with movements of joints in the user's legs, and shoe-like foot attachment portions each provided at the lower end of the leg link.

In order to support the body weight of the user, this walking assistance device is configured to apply an assisting force from the leg links toward the user (i.e., center of the waist). To be more specific, when the user stands on two legs, the assisting force applied from the leg links toward the user is distributed at a ratio of 50:50. On the contrary, when the user is walking, the assisting force is distributed, for example, 100% to one leg link and 0% to the other leg link. Accordingly, the walking assistance device can support the weight of the user at the instance when the user is supported on one leg while walking.

However, if the user with the above walking assistance device walks with long steps, the direction to which the assisting force is applied tilts to a large extent toward the front-rear direction and therefore the horizontal component (i.e., component in the front-rear direction) of the assisting force also increases to a large extent. For this reason, the user may experience an uncomfortable feeling at the instance when his leading foot that has left the ground for walking contacts the ground to change the step; the user may feel as if he is pushed back.

In view of the above, it would be desirable to provide a walking assistance device which can suppress the uncomfortable feeling of the user at the instance of changing the step.

SUMMARY OF THE INVENTION

According to one aspect of the present invention, there is provided a walking assistance device comprising a seating member configured to provide seating for a user to sit astride, and leg links connected to the seating member. The seating member comprises: a supporting member configured to support the user sitting on the seating member from below the seating member; a movable member configured to contact an inguinal region of the user supported by the supporting member and to be movably supported by the supporting member; and at least one elastic member provided between the movable member and the supporting member and configured to be deformable in accordance with a force applied from the inguinal region of the user to the movable member.

With this configuration of the walking assistance device, when a force is generated in a diagonally upward and rearward direction from one of the leg links in changing the step and even if the force has a large horizontal component in the front-rear direction, the uncomfortable feeling can be eased. This is because, if the force with a large horizontal component is applied and the supporting member is displaced rearward, the movable member together with the user are relatively moved frontward with respect the supporting member, which causes the elastic member to be deformed to absorb the force.

In the aforementioned walking assistance device, the supporting member may comprise a bifurcated portion provided at a front side of the supporting member and having a shape corresponding to the inguinal region of the user, and it is preferable that space for allowing movements of the movable member with respect to the bifurcated portion is provided between the movable member and the bifurcated portion, and the elastic member is located outside the space.

With this configuration, as compared with a structure in which elastic members are provided in the space between the bifurcated portion and the movable member, a sufficient stroke length of the movable member can be obtained, so that the elastic member can efficiently absorb the force.

In the aforementioned walking assistance device, the movable member may be shaped like a cap for covering the space.

With this configuration, the user does not get his upper leg pinched between the movable member and the bifurcated portion during the use of the walking assistance device.

In the aforementioned walking assistance device, the movable member may be rotatably supported by the supporting member.

With this configuration, since the movable member is rotatable, a smooth operation of the movable member can be achieved as compared with a structure in which the movable member slides linearly, i.e., the structure in which a guide surface for guiding the movable member is small and the movable member sliding along the guide surface is easily tilted and trapped by the guide surface.

In the aforementioned walking assistance device, the supporting member may have a stopper portion, by which a rearward movement of the movable member is restricted, and the elastic member may be retained with an initial load applied thereto such that when the walking assistance device is not in use, the movable member is urged toward the stopper portion.

As an alternative, the bifurcated portion may have stopper portions, by which a rearward movement of the movable member is restricted, and the elastic member may be retained with an initial load applied thereto such that when the walking assistance device is not in use, the movable member is urged toward the stopper portions.

With this configuration, since the elastic member is not easily deformed in the normal gait and movements of the movable member can be restricted, the movable member is reliably kept fitted to the inguinal region of the user to realize smooth walking of the user. Further, in a structure in which the elastic member has its natural length during the non-use period of the walking assistance device, the elastic member is likely to deform when the user sits on the seat, and accordingly the actual stroke length of the movable member may be disadvantageously shortened according to this deformation of the elastic member. However, setting the initial load of the elastic member as describe above can overcome this drawback.

In the aforementioned walking assistance device, a lower end portion of the movable member may be rotatable about an axis of rotation provided at distal end portions of the bifurcated portion.

With this configuration, since the lower end portion of the movable member is configured to be rotatable about the axis of rotation provided at the distal end portions of the bifurcated portion, the stroke length of the lower end portion can be increased as compared with a structure in which the movable member is rotatable at its upper end portion with the lower end portion thereof being pivotally supported on the bifurcated portion. The rotational movement of the lower end portion can efficiently absorb the assisting force applied from the leg links.

According to a first specific embodiment of the present invention, the aforementioned walking assistance device may be configured such that the movable member consists of a pair of right and left movable members corresponding to distal end portions of the bifurcated portion, and that the pair of movable members are urged by one elastic member toward the stopper portions.

With this configuration of the walking assistance device, the uncomfortable feeling of the user can be eased by a simple configuration.

According to a second specific embodiment of the present invention, the aforementioned walking assistance device may be configured such that the movable member consist of a pair of right and left movable members corresponding to distal end portions of the bifurcated portion, and a pair of right and left elastic members are provided corresponding to the pair of movable members, and that the pair of movable members are independently movable to one another.

With this configuration of the walking assistance device, since the right and left elastic members are independently deformable in accordance with forces applied from right and left inguinal regions of the user, the right and left movable members are always closely contacted with the right and left inguinal regions of the user to provide a comfortable fit.

Further, in the aforementioned walking assistance device, the elastic member may be provided between the lower end portion of the movable member and a rear end portion of the supporting member so that the lower end portion of the movable member is pulled rearward by the elastic member.

Further, in the aforementioned walking assistance device according to the second specific embodiment, each of the movable members may include a rotation center portion configured to be rotatably supported on one of distal end portions of the bifurcated portion, a rear wall portion extending from the rotation center portion along a rear surface of the bifurcated portion, and a projecting portion configured to extend forward from the rotation center portion, and each of the elastic members may be provided between the projecting portion and the supporting member so that the projecting portion is pulled downward by the elastic member.

BRIEF DESCRIPTION OF THE DRAWINGS

Other objects and aspects of the present invention will become more apparent by describing in detail illustrative, non-limiting embodiments thereof with reference to the accompanying drawings, in which.

DETAILED DESCRIPTION OF THE INVENTION

With reference to the attached drawings, a walking assistance device according to one exemplary embodiment of the present invention will be described.

Figure 1:
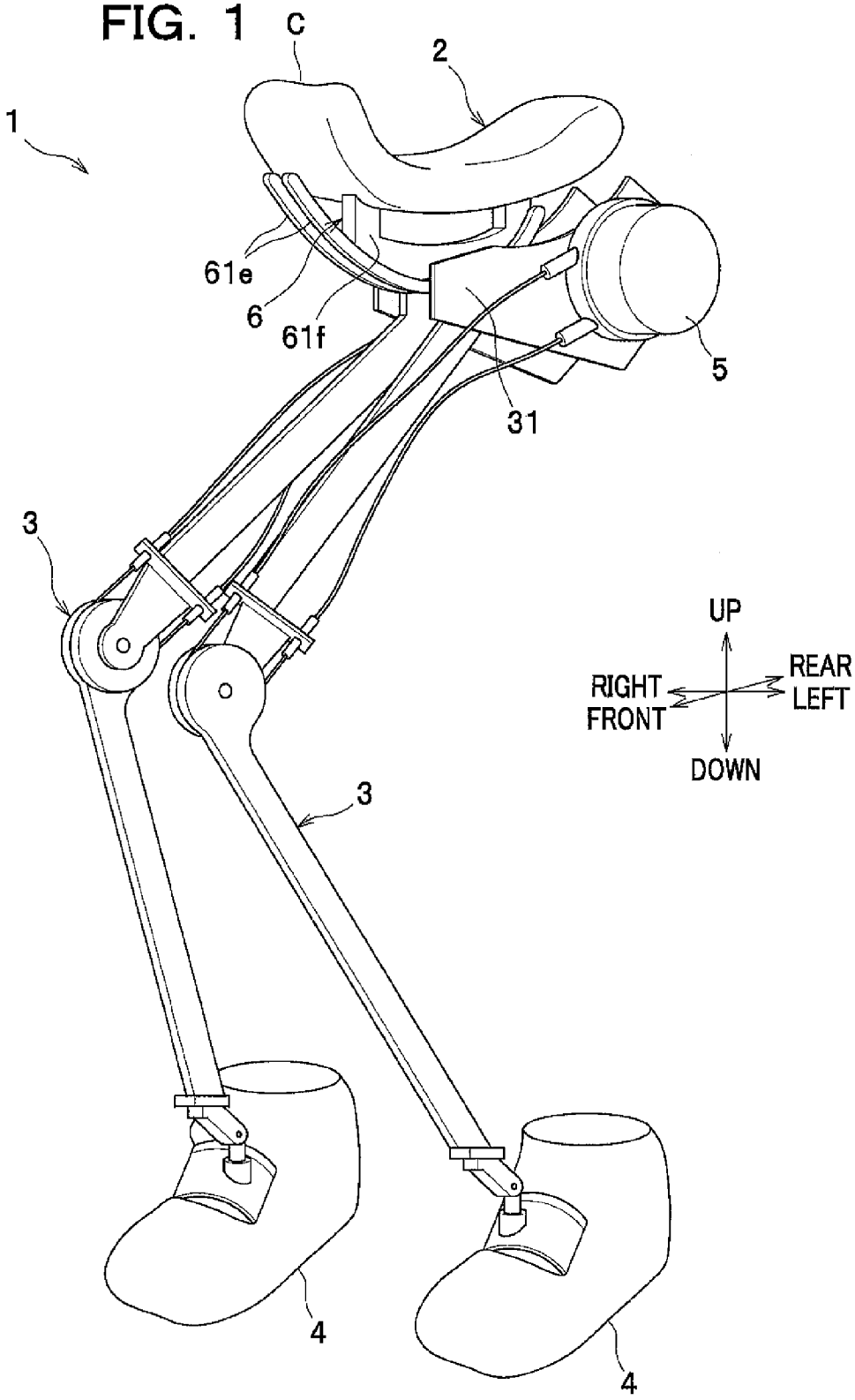
FIG. 1 is a perspective view showing a walking assistance device according to one exemplary embodiment of the present invention.

As seen in FIG. 1, a walking assistance device 1 includes a seating member 2 configured to provide seating for a user to sit astride, a pair of leg links 3 connected to the seating member 2, shoe-like members 4 provided at lower ends of the leg links 3, and a pair of motors 5 provided corresponding to the leg links 3 and configured to drive the leg links 3. When the walking assistance device 1 is used, the user sits on the seating member 2 while putting his feet into the shoe-like members 4.

According to the walking assistance device 1, each motor 5 generates torque at a joint in the leg link 3 with the shoe-like members 4 being put on the user's feet, so that an upwardly directed assisting force (lifting force) is exerted on the user from the seating member 2. To be more specific, the assisting force is directed toward a virtual center that is present above the seating member 2 within the region defined by the front-rear distance of the contact surface between the seating member 2 and the user (i.e., swinging fulcrum of the leg links 3; e.g., center of curvature of the arcuate rail portions 61*e* to be describe later in the case where the arcuate rail portions have a constant curvature).

A plurality of sensors (not shown) are provided in the shoe-like members 4 and the leg links 3, and based on information from the sensors, a controller (not shown) determines a target value of the assisting force. The controller then distributes the assisting force at an appropriate ratio to the right and the left, respectively, and the distributed forces are generated at the right and left leg links 3. For example, when the user stands on two legs, the weight of the user is evenly distributed to and put on both feet of the user. In this case, the distribution ratio of the assisting force is 50:50. On the contrary, when the user is walking with one foot leaving the ground (hereinafter referred to as a "non-contact phase") and the other foot contacting the ground, the assisting force is distributed 0% to one leg link 3 for the one foot in the non-contact phase and 100% to the other leg link 3.

When the foot of the user in the non-contact phase contacts the ground and this action is detected by the sensors, the controller distributes an appropriate distributed force to the leg link 3 corresponding to the foot contacting the ground. For this reason, if the user with the walking assistance device 1 walks with long steps (hereinafter also referred to as a "long-step gait"), the assisting force which is tilted to a large extent in the front-rear direction is exerted toward the user (i.e., virtual center) at the instance when the user's foot in the non-contact phase contacts the ground.

The seating member 2 includes a cap C, a seating frame 6 disposed in the cap C and made of plastics resin (see FIG. 2), and cushion material such as styrene beads and cotton filled in a space between the cap C and the seating frame 6.

Figure 2:
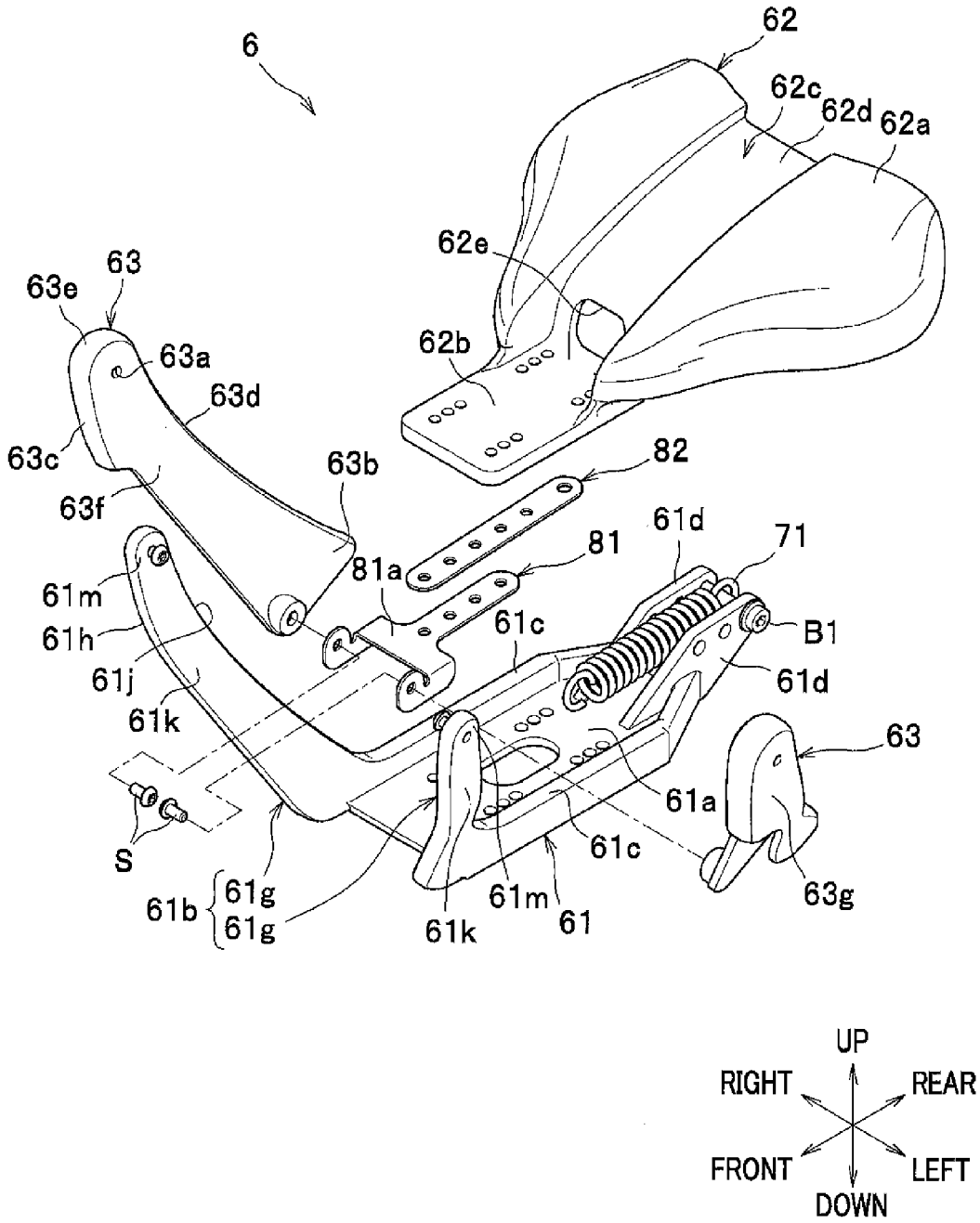
FIG. 2 is an exploded perspective view of a seating frame shown in FIG. 1.

As seen in FIG. 2, the seating frame 6 includes a supporting member 61, a saddle frame 62 supported on the supporting member 61 and configured to be slidable in the front-rear direction with respect to the supporting member 61, and two movable members 63 rotatably (movably) supported on the supporting member 61. A tension coil spring 71 as an example of an elastic member, a first connecting member 81 and a second connecting member 82 are provided between the movable members 63 and the supporting member 61.

Herein, the wording "provided between" indicates that a part (or parts) is interposed between mechanistically connected (associated) members. Namely, according to this embodiment, the wording "provided between the movable members 63 and the supporting member 61" can be construed as meaning that the supporting member 61 and the movable members 63 are mechanically connected via the tension coil spring 71 and the first and second connecting members 81, 82, and the tension coil spring 71 is interposed between these interconnected members, i.e., the supporting member 61 and the movable members 63.

The supporting member 61 is a frame configured to support the user sitting on the seating member 2 from below through the saddle frame 62. The supporting member 61 mainly includes a flat plate-shaped base portion 61*a*, and a bifurcated portion 61*b* integral with the base portion 61*a* and provided at a front end of the base portion 61*a*.

Upwardly protruding guide ribs 61*c* are formed at the right and left ends of the base portion 61*a*, respectively. Accordingly, the saddle frame 62 is allowed to slide in the front-rear direction along the upper surface of the base portion 61*a* while the movement thereof in the right-left direction is restricted by the pair of guide ribs 61*c*.

The saddle frame 62 is positioned at a predetermined position with respect to the base portion 61*a* by means of conventionally-known engagement protrusions and locking member.

Spring attachment portions 61*d* for attaching the rear end of the tension coil spring 71 are provided at the rear end of the base portion 61*a*. To be more specific, the spring attachment portions 61*d* are a pair of plate-shaped ribs disposed spaced apart in the right-left direction and extending diagonally upward and rearward from the rear end of the base portion 61*a*.

A bolt B1 is provided at the rear ends of the pair of spring attachment portions 61*d*; the bolt B1 connects the spring attachment portions 61*d*, and the rear end of the tension coil spring 71 is attached to the bolt B1.

As best seen in FIG. 1, a pair of arcuate rail portions 61*e* are fixed to the under surface of the base portion 61*a* through connecting members 61*f*. Each rail portion 61*e* is rotatably supported by a supporting plate 31 provided at an upper side of the leg link 3 so that forward and rearward movements of the seating member 2 along the rail portions 61*e* can be performed. Accordingly, the seating member 2 can be supported by the leg links 3 in a stable posture without staggering in the front-rear direction.

As best seen in FIG. 2, the bifurcated portion 61*b* is provided at the front end of the base portion 61*a* and configured to have two separate parts having a shape corresponding to an inguinal region of the user. To be more specific, the bifurcated portion 61*b* consists of a pair of extension portions 61*g* disposed spaced apart in the right-left direction.

The saddle frame 62 includes a saddle portion 62*a* for supporting buttocks of the user, and a plate-shaped slider portion 62*b* extending forward from the front end of the saddle portion 62*a* and slidably supported on the base portion 61*a*. The saddle portion 62*a* has a substantially triangular shape with its two sides tapered toward the front, and a groove 62*c* extends from the center of the base to the vertex of the triangle.

Figure 3:
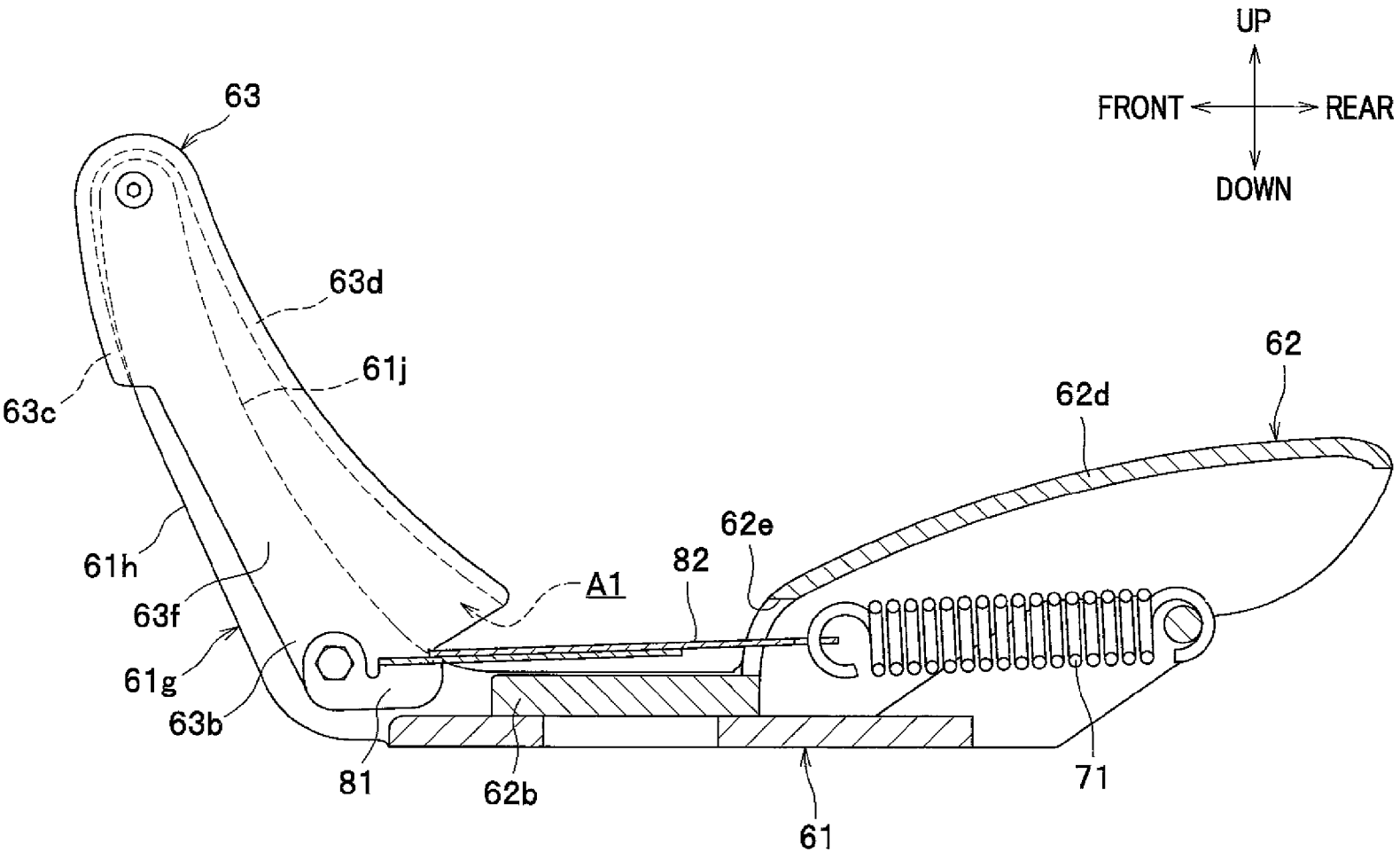
FIG. 3 is a longitudinal cross section of the seating frame taken along the horizontal mid-point of the width of the seating frame.

As seen in FIG. 3, the bottom wall portion 62*d* which constitutes the groove 62*c* has a curved surface; the bottom wall portion 62*d* rises upward from the rear end of the slider portion 62*b* and gently extends diagonally upward and rearward. A through-opening 62*e* is formed in the bottom wall portion 62*d* at a front-side position thereof where the bottom wall portion 62*d* rises upward.

With this configuration of the saddle frame 62, the tension coil spring 71 can be arranged in a space below the bottom wall portion 62*d*, and the second connecting member 82 attached to the front end of the tension coil spring 71 is allowed to slide in the front-rear direction through the through-opening 62*e*.

As best seen in FIG. 2, each of the movable members 63 is shaped like a cap for covering the corresponding extension portion 61*g* of the bifurcated portion 61*b*. The movable members 63 are arranged substantially in the same positions as those of the extension portions 61*g* so as to contact the inguinal region of the user supported by the supporting member 61. The movable members 63 are rotatably mounted at their upper end portions 63*a* to distal end portions 61*m* of the bifurcated portion 61*b*, and the lower end portions 63*b* of the movable members 63 become rotatable (i.e., movable) substantially in the front-rear direction.

To be more specific, each movable portion 63 consists of a front wall 63*c* formed along a front surface 61*h* of the extension portion 61*g*, a rear wall 63*d* formed along a rear surface 61*j* of the extension portion 61*g*, a curved upper wall 63*e* connecting the upper end of the front wall 63*c* and the upper end of the rear wall 63*d*, and an inner wall 63*f* and an outer wall 63*g* formed along right and left side surfaces 61*k* of the extension portion 61*g*.

The movable member 63 is configured such that, when the front wall 63*c* thereof is brought into contact with the front surface 61*h* of the extension portion 61*g* as an example of a stopper portion (see FIG. 3), the rearward movement of the movable member 63 is restricted, and when the rear wall 63*d* thereof is brought into contact with the rear surface 61*j* of the extension portion 61*g* (see FIG. 4), the forward movement of the movable member 63 is restricted. In other words, the movable member 63 is positioned in the rear-most position when the front wall 63*c* thereof is brought into contact with the front surface 61*h* of the extension portion 61*g*, and positioned in the forward-most position when the rear wall 63*d* thereof is brought into contact with the rear surface 61*j* of the extension portion 61*g*.

Figure 4:
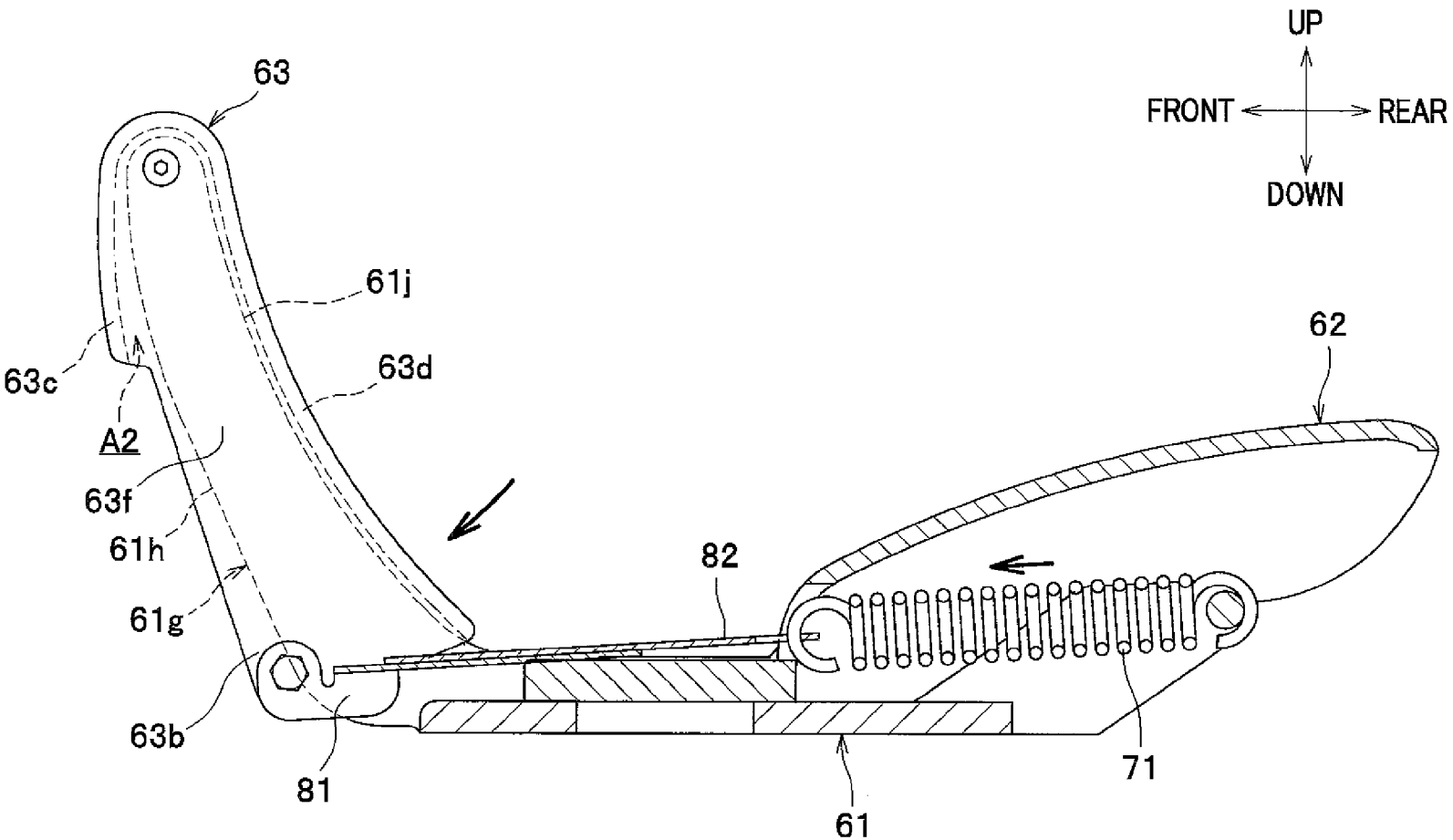
FIG. 4 is a sectional view illustrating a state in which a movable member is rotated forward.
Figure 5:
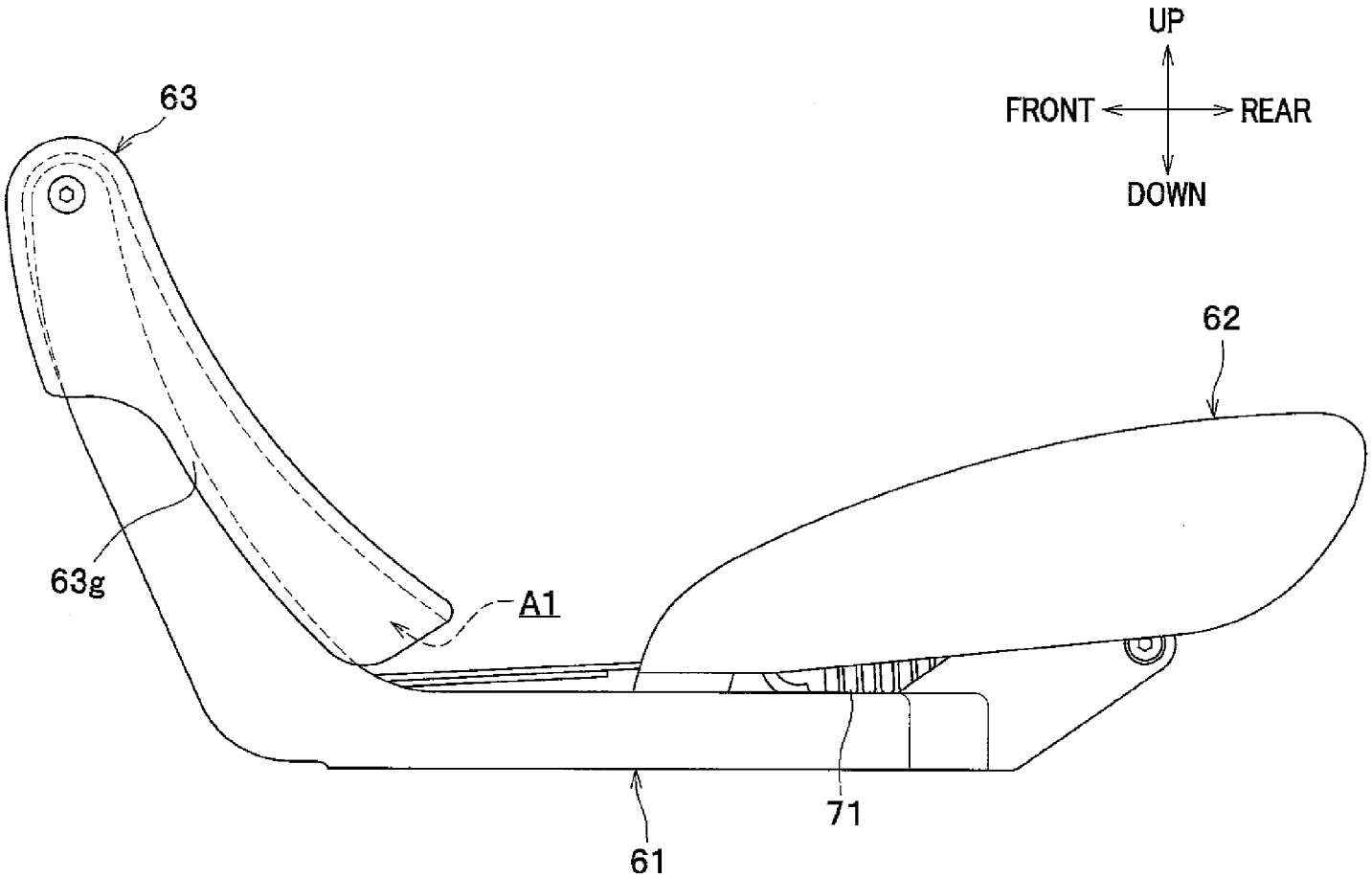
FIG. 5 is a side view of the seating frame.

Space A1, A2 for allowing the rotation (movements) of the movable member 63 with respect to the extension portion 61*g* is provided between the movable member 63 and the extension portion 61*g* of the bifurcated portion 61*b*. To be more specific, when the movable member 63 is rotated to the position shown in FIG. 3, space A1 is formed between the rear wall 63*d* of the movable member 63 and the rear surface 61*j* of the extension portion 61*g*, and when the movable member 63 is rotated to the position shown in FIG. 4, space A2 is formed between the front wall 63*c* of the movable member 63 and the front surface 61*h* of the extension portion 61*g*. Further, as seen in FIGS. 3 to 5, the inner wall 63*f* and the outer wall 63*g* of the movable member 63 are formed to have a sufficient size to cover the space A1, A2 within the range of the rotation of the movable member 63.

With this configuration of the movable members 63, the user does not get his upper leg pinched between the movable member 63 and the extension portion 61*g* of the bifurcated portion 61*b*.

As best seen in FIG. 2, the lower end portion 63*b* of each movable member 63 is connected to the tension coil spring 71 via the first connecting member 81 and the second connecting member 82. To be more specific, the first connecting member 81 has a bifurcated front end portion 81*a*, and the lower end portions of the pair of movable members 63 are pivotally supported to the distal end portions of the bifurcated front end portion 81*a* by screws S. Accordingly, the movable members 63 become rotatable in the front-rear direction in synchronization with the front-rear movements of the first connecting member 81.

The second connecting member 82 extending in the front-rear direction and shaped like an elongated plate is fixed to the rear side of the first connecting member 81 by screwing, bonding, welding, etc. The front end of the tension coil spring 71 is attached to the rear side of the second connecting member 82.

Therefore, when a force is applied from the inguinal region of the user to the movable members 63 retained in the positions shown in FIG. 3, the movable members 63 rotate forward against the tensile force of the tension coil spring 71 toward the positions as shown in FIG. 4 and the force applied from the user is absorbed by the deformation of the tension coil spring 71.

The tension coil spring 71 is located outside the spaces A1, A2 between the movable members 63 and the extension portions 61*g* (more specifically, disposed between the lower end portions 63*b* of the movable members 63 and the rear end portion of the supporting member 61) so that the lower end portions 63*b* of the movable members 63 are pulled rearward by the tension coil spring 71. According to this arrangement, as compared with a structure in which compression springs are provided in the spaces A1, A2, the stroke length of the movable members 63 can be increased and the tension coil spring 71 can efficiently absorb the force applied from the user.

Further, the tension coil spring 71 is retained with an initial load applied thereto so that when the walking assistance device 1 is not in use, the movable members 63 are urged toward the rear-most position (i.e., toward the front surfaces 61*h* of the extension portions 61*g*; see FIG. 3). With this configuration, since the tension coil spring 71 is not easily deformed during the normal use of the walking assistance device 1, the movable members 63 are reliably kept fitted to the inguinal region of the user to realize smooth walking of the user.

Preferably, the initial load of the tension coil spring 71 is set such that when the user normally uses the walking assistance device 1 (i.e., when the user walks in the normal gait without taking long steps in the front-rear direction), the horizontal component of the assisting force in the front-rear direction that is applied to the supporting member 61 (i.e., force directed in the rearward direction) does not cause the tension coil spring 71 to be deformed. Herein, the wordings "normal use of the walking assistance device 1" and "normally uses the walking assistance device 1" indicate that the angle made by the pair of leg links 3 (i.e., two upper leg frames constituting the pair of leg links 3) positioned near the supporting member 61 (not near the shoe-like members 4) is kept within a predetermined angle range.

Operations of the movable members 63 and the like during the use of the walking assistance device 1 will be explained below.

When the user uses the walking assistance device 1, he/she sits astride on the seating member 2 shown in FIG. 1 and puts his feet into the shoe-like members 4. The user then moves the saddle frame 62 or the supporting member 61 shown in FIG. 2 forward or rearward for adjusting the front-rear length of the seating member 2 in accordance with the user's body shape.

To be more specific, the user moves the bifurcated portion 61*b* rearward with respect to the saddle frame 62 while retaining the saddle frame 62. As an alternative, the user may move himself forward together with the saddle frame 62 while retaining the bifurcated portion 61*b*. This can cause the movable members 63 to be contacted with the user's inguinal region. Therefore, the user is sandwiched between the movable members 63 and the rear side of the saddle frame 62, which can prevent the seating member 2 from being shifted in the front-rear direction with respect to the user when the user walks with the walking assistance device 1.

In this embodiment, the movable members 63 are not easily movable because the initial load is applied to the tension coil spring 71. Accordingly, even if the movable members 63 contact the user with a relatively strong force during the adjustment of the front-rear length of the seating member 2, each of the movable members 63 can be retained in the initial position. This makes it possible to keep a sufficient stroke length of the movable members 63 when the user walks with long steps.

After the user brings the movable members 63 into contact with his inguinal region, he/she engages the saddle frame 62 with the supporting member 61 to lock the saddle frame. The walking assistance device 1 is now ready for use. In the case where the user with the walking assistance device 1 walks with long steps, the assisting force with a large component directed in the rear direction generates toward the supporting member 61 at the instance when the user's leading foot that has left the ground for walking contacts the ground.

In this instance, the movable members 63 are relatively moved forward with the user with respect to the supporting member 61 that is moved rearward by the assisting force, to thereby deform the tension coil spring 71. Therefore, the tension coil spring 71 absorbs an abrupt assisting force. Namely, when the user with the walking assistance device 1 walks with long steps, the assisting force (i.e., body weight supporting force) generated by the motor 5 is applied from the front-side of the user, so that a force is exerted on the movable members 63 from the inguinal region of the user. The tension coil spring 71 then deforms in accordance with this force to absorb the abrupt assisting force.

Preferably, the rotation direction of the movable members 63 is set such that while the inguinal region of the user contacts the movable members 63, those parts of the movable members 63 which contact the user start to move in the same direction as (parallel to) that of the assisting force applied toward the user during the long-step gait. In other words, as viewed from side, the direction in which the contacting parts of the movable members 63 starts to move in the long-step gait is preferably set to conform with (to be parallel to) the straight line connecting the virtual center to which the assisting force is directed (i.e., the virtual center located above the seating member 2) and the contacting parts of the movable members 63. For this reason, it is preferable to set the rotation center of each movable member 63, the shape of the movable member 63, and the like such that the movable members 63 are rotated in the above-described direction.

According to the walking assistance device 1 in this embodiment, the following advantageous effects can be achieved.

Since the tension coil spring 71 absorbs the assisting force in changing the step, an uncomfortable feeling experienced by the user in changing the step can be eased.

Since the tension coil spring 71 is located outside the spaces A1, A2 between the movable members 63 and the extension portions 61*g* of the bifurcated portion 61*b*, as compared with a structure in which compression springs are provided in the spaces A1, A2, the stroke length of the movable members 63 can be increased and the tension coil spring 71 can efficiently absorb the assisting force.

Since each movable member 63 extends along the side surfaces 61*k* of the bifurcated portion 61*b* and is shaped like a cap for covering the space A1, A2, the user does not get his upper leg pinched between the movable member 63 and the bifurcated portion 61*b* during the use of the walking assistance device 1.

Since the initial load is applied to the tension coil spring 71 so that movements of the movable members 63 can be restricted in the normal gait, the movable members 63 are reliably kept fitted to the inguinal region of the user to realize smooth walking of the user. Further, since the movable members 63 are not easily movable during the adjustment of the front-rear length of the seating member 2 because the initial load is applied to the tension coil spring 71, it is possible to keep a sufficient stroke length of the movable members 63 when the user walks with long steps.

Since the movable members 63 are rotatably supported on the supporting member 61, smooth operations of the movable members 63 can be achieved as compared with a structure in which the movable members slide linearly, i.e., the structure in which guide surfaces for guiding the movable members are small and the movable members sliding along the guide surfaces are easily tilted and trapped by the guide surfaces.

Since the lower end portions 63*b* of the movable members 63 are configured to be rotatable (movable) about axes of rotation provided at the distal end portions 61*m* of the bifurcated portion 61*b*, the stroke length of the lower end portions 63*b* can be increased as compared with a structure in which the movable members are rotatable at their upper end portions with the center portions or the lower end portions thereof being pivotally supported on the bifurcated portion 61*b*. The rotational movements of the lower end portions 63*b* can efficiently absorb the assisting force applied from the leg links 3.

Since the front side of the supporting member 61 is formed as the bifurcated portion 61*b*, even if the bifurcated portion 61*b* hits the user's upper leg when the user's leg is left the ground and swung forward, the bifurcated portion 61*b* deforms in the right-left direction to suppress yawing (i.e. rotation around the vertical axis) of the seating member 2.

Although the present invention has been described in detail with reference to the above exemplary embodiment, the present invention is not limited to this specific embodiment and various changes and modifications may be made without departing from the scope of the appended claims. In the drawings to be referred to in the following description, parts similar to those previously described in the above embodiment are denoted by the same reference numerals and detailed description thereof will be omitted.

Figure 6:
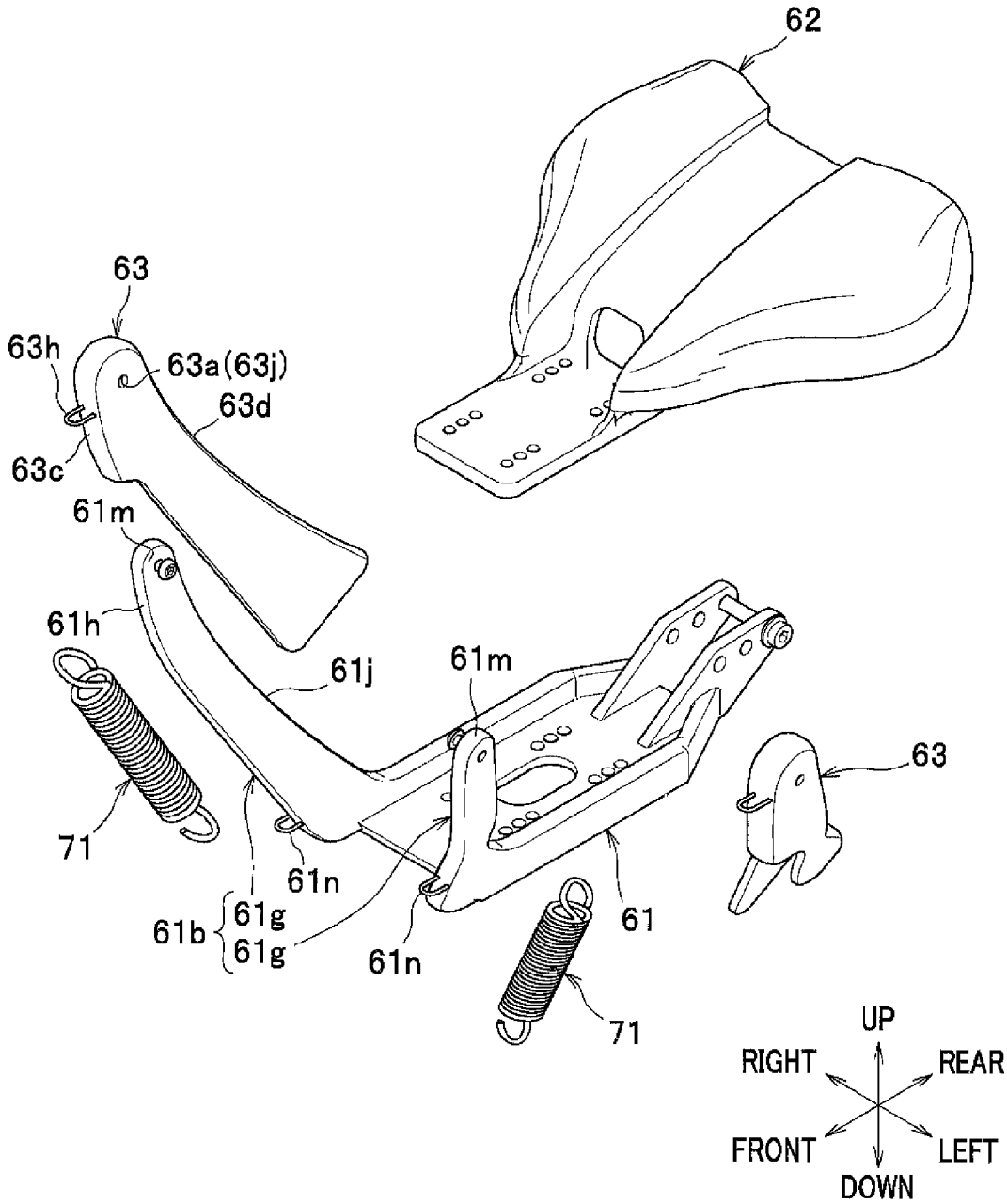
FIG. 6 is an exploded perspective view of a seating frame according to another embodiment.
Figure 7:
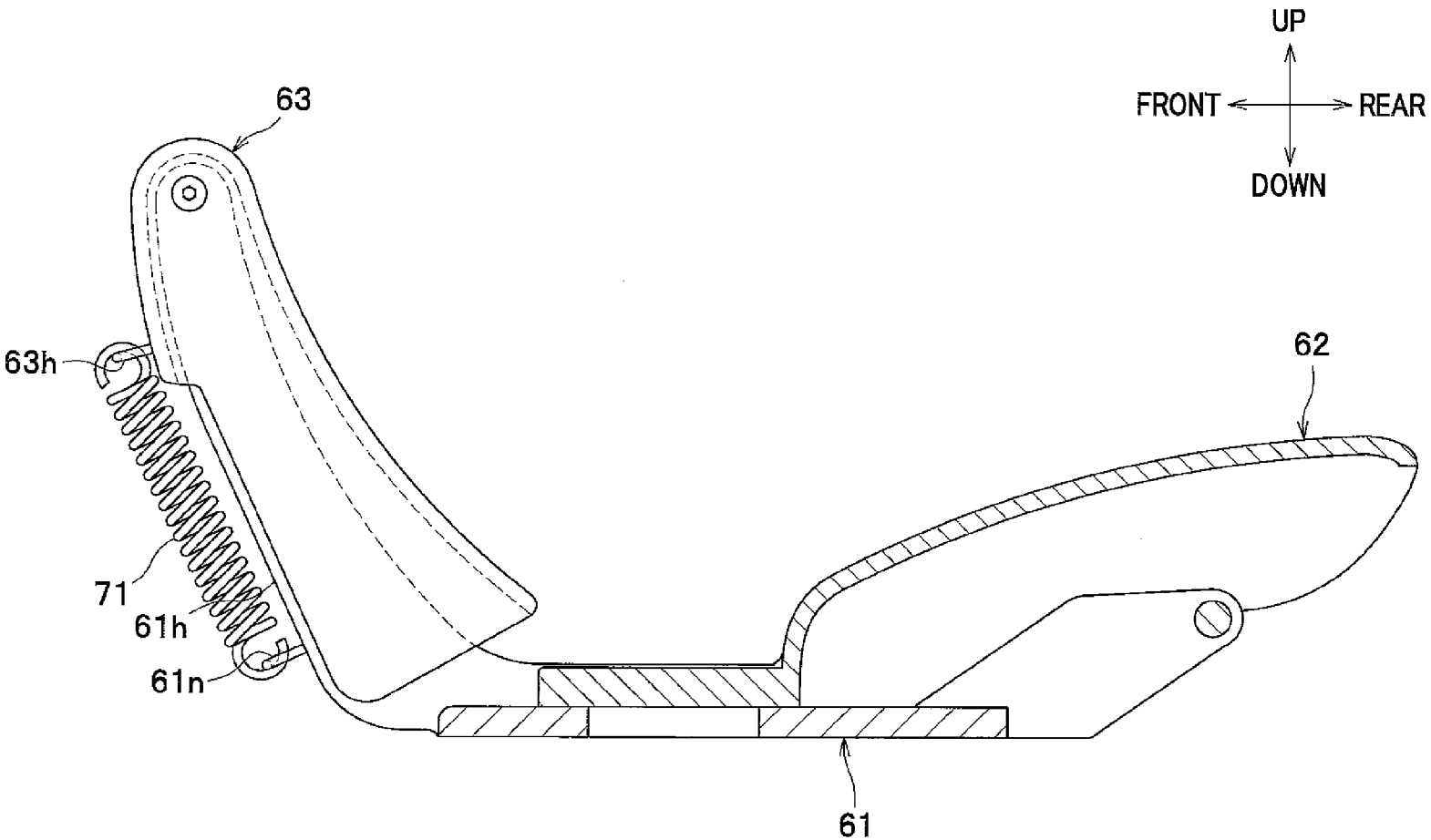
FIG. 7 is a longitudinal cross section of the seating frame of FIG. 6 taken along the horizontal mid-point of the width of the seating frame.

In the above embodiment, the two movable members 63 are connected by the first connecting member 81 and synchronously rotatable. However, the present invention is not limited to this specific configuration. For example, as best seen in FIGS. 6 and 7, a pair of right and left movable members 63 and a pair of right and left tension coil springs 71 may be provided at right and left sides of the supporting member 61, respectively, and each of these movable members 63 may be independently movable.

To be more specific, the movable members 63 are configured to have substantially the same shapes as those of the above exemplary embodiment, and the front wall 63*c* of each movable member 63 has a first ring portion 63*h* as an example of a projecting portion extending forward. In other words, each movable member 63 includes a rotation center portion 63*j* (upper end portion 63*a*) configured to be rotatably supported on the corresponding distal end portion 61*m* of the bifurcated portion 61*b*, a rear wall portion 63*d* extending from the vicinity of the rotation center portion 63*j* along the rear surface 61*j* of the bifurcated portion 61*b*, and the first ring portion 63*h* configured to extend forward from the vicinity of the rotation center portion 63*j*.

Each of the tension coil springs 71 is provided between the first ring portion 63*h* and the supporting member 61 so that the first ring portion 63*h* is pulled downward by the tension coil spring 71. To be more specific, the upper end of the tension coil spring 71 is attached to the first ring portion 63*h*, and the lower end of the tension coil spring 71 is attached to a second ring 61*n* extending forward from the front surface 61*n* of the bifurcated portion 61*b*.

With this configuration, the right and left tension coil springs 71 are independently deformable in accordance with the forces applied from right and left inguinal regions of the user. Therefore, even if loads of different magnitudes are applied to the right and left movable members 63, e.g., when the user twists his waist, the right and left movable members 63 are always closely contacted with the right and left inguinal regions of the user to provide a comfortable fit.

Figure 8:
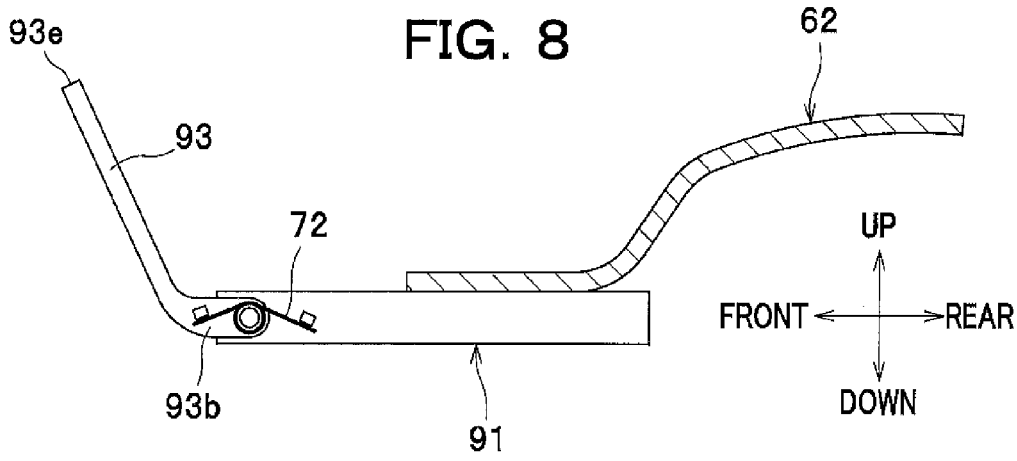
FIG. 8 is a schematic view explaining an embodiment in which the movable member is pivotally supported at its lower end portion.

In the above embodiment, the lower end portions 63*b* of the movable members 63 are configured to be rotatable (movable) with the movable members 63 being rotatably supported on the distal end portions 61*m* of the bifurcated portion 61*b*. However, the present invention is not limited to this specific configuration. For example, as seen in FIG. 8, the lower end portion 93*b* of each movable member 93 may be rotatably supported on a supporting member 91 so as to allow rotational movements of the upper end portion 93*e*, and a torsion spring 72 may be provided between the movable member 93 and the supporting member 91 to urge the movable member 93 rearward (i.e., counterclockwise direction in the FIGURE).

According to this modification, the advantageous effects such as those achieved by the above embodiment can be obtained. In this modification, the movable member 93 may have a bifurcated shape. Alternatively, the movable member 93 may be divided into two separate movable members constituting right and left halves of the movable member 93 to provide a bifurcated portion between the movable member 93 and the supporting member 91.

Figure 9:
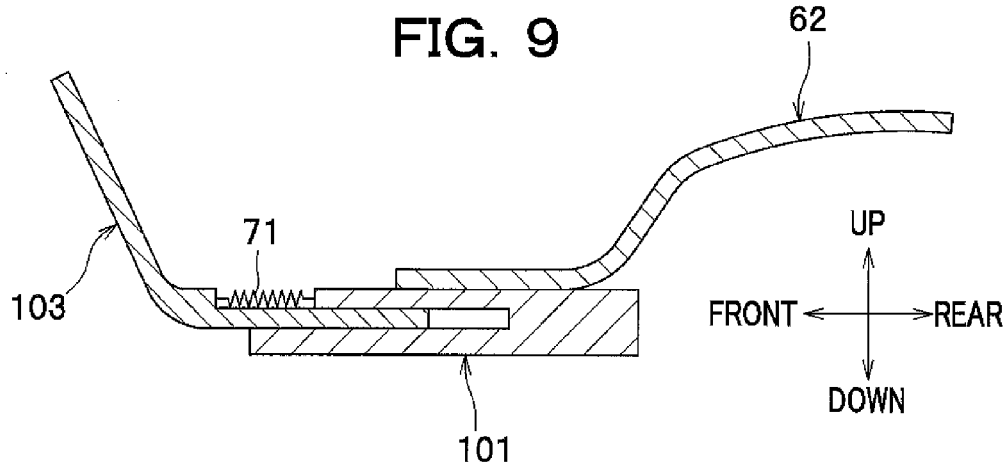
FIG. 9 is a schematic view explaining an embodiment in which the movable member is slidable in the front-rear direction.

Further, as best seen in FIG. 9, a bifurcated movable member 103 (or a pair of right and left movable members 103) may be provided so as to be slidable in the front-rear direction with respect to a supporting member 101, and tension coil springs 71 may be provided between the bifurcated movable member 103 and the supporting member 101. According to this modification, too, the advantageous effects such as those achieved by the above embodiment can be obtained.

Figure 10:
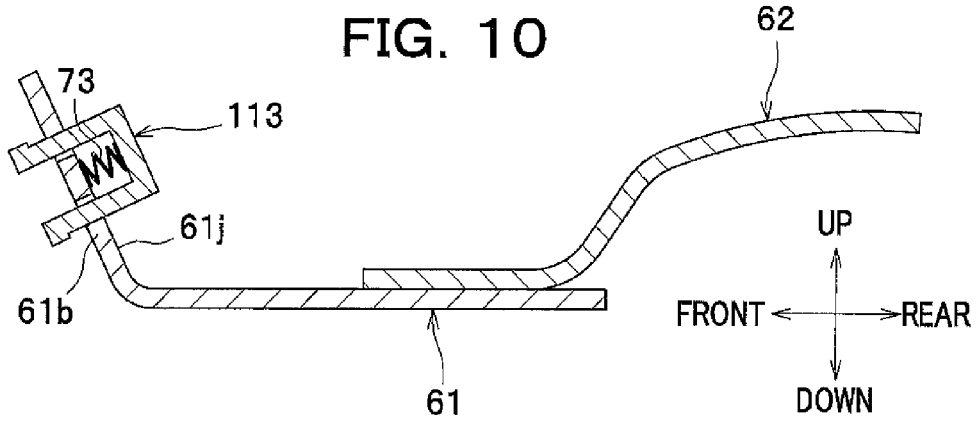
FIG. 10 is a schematic view explaining an embodiment in which the movable member is slidable with respect to a bifurcated portion.

Further, as best seen in FIG. 10, the bifurcated portion 61*b* of the supporting member 61 that is substantially the same as that disclosed in the above embodiment may be provided with a pair of movable members 113 linearly movable in a direction orthogonal to the rear surfaces 61*j* of the bifurcated portion 61*b*, and compression springs 73 may be provided between the movable members 113 and the bifurcated portion 61*b*. According to this modification, too, the advantageous effects such as those achieved by the above embodiment can be obtained.

According to this modification, it is preferable that the moving direction of the movable members 113 conforms with (parallel to) the direction of the assisting force applied toward the user during the long-step gait. This makes it possible to more efficiently absorb the assisting force.

In these modifications as shown in FIGS. 8 to 10, the movable members 93, 103, 113, the elastic members 72, 71, 73, and the supporting members 91, 101, 61 are mechanistically connected (associated), and elastic members are provided between the movable members and the supporting member.

Further, the movable member may have any shape as long as it can be brought into contact with the inguinal region of the user. For example, the movable member may have a ring shape such as formed by connecting the distal end portions of the bifurcated portion.

In the above embodiment and various modifications thereof, a spring such as the tension coil spring 71 and the compression spring 73 is used as an elastic member. However, the present invention is not limited to this specific configuration. For example, the elastic member may be made of rubber as long as it can allow elastic deformation within the stroke range of the movable member.

In the above embodiment, each movable member 63 (i.e., the lower end portion 63*b* of the movable member 63) is movable (rotatable) substantially in the front-rear direction. However, the present invention is not limited to this specific configuration. As long as the movable member is movable at least in a direction where a force is applied from the inguinal region of the user to the movable member, the movable member may be of any configuration. In other words, as long as the movable member is movable at least in a direction where the assisting force is applied from the leg link toward the user at the instance when the user's leading foot that has left the ground contacts the ground in the long-step gait (i.e., every direction except for the one orthogonal to the direction where the assisting force is applied), the movable member may be of any configuration. Herein, the wording "long-step gait" indicates that the angle made by the pair of right and left leg links (i.e., two upper leg frames constituting the pair of leg links) becomes equal to or greater than a predetermined angle. The predetermined angle may be determined based on experiments or simulation results.

What is claimed is:

1. A walking assistance device comprising a seating member configured to provide seating for a user to sit astride, and leg links connected to the seating member, wherein the seating member comprises: a supporting member configured to support the user sitting on the seating member from below the seating member; a movable member configured to contact an inguinal region of the user supported by the supporting member and to be movably supported by the supporting member; and at least one elastic member provided between the movable member and the supporting member and configured to be deformable in accordance with a force applied from the inguinal region of the user to the movable member;

wherein the supporting member comprises a bifurcated portion provided at a front side of the supporting member and having a shape corresponding to the inguinal region of the user, wherein space for allowing movements of the movable member with respect to the bifurcated portion is provided between the movable member and the bifurcated portion, and the elastic member is located outside the space.

2. The walking assistance device according to claim 1, wherein the movable member is shaped like a cap for covering the space.

3. The walking assistance device according to claim 1, wherein the movable member is rotatably supported by the supporting member.

4. The walking assistance device according to claim 1, wherein the supporting member has a stopper portion, by which a rearward movement of the movable member is restricted, and wherein the elastic member is retained with an initial load applied thereto such that when the walking assistance device is not in use, the movable member is urged toward the stopper portion.

5. The walking assistance device according to claim 1, wherein the bifurcated portion has stopper portions, by which a rearward movement of the movable member is restricted, and wherein the elastic member is retained with an initial load applied thereto such that when the walking assistance device is not in use, the movable member is urged toward the stopper portions.

6. The walking assistance device according to claim 1, wherein a lower end portion of the movable member is rotatable about an axis of rotation provided at distal end portions of the bifurcated portion.

7. The walking assistance device according to claim 5, wherein the movable member consists of a pair of right and left movable members corresponding to distal end portions of the bifurcated portion, and the pair of movable members are urged by one elastic member toward the stopper portions.

8. The walking assistance device according to claim 1, wherein the movable member consist of a pair of right and left movable members corresponding to distal end portions of the bifurcated portion, and a pair of right and left elastic members are provided corresponding to the pair of movable members, and wherein the pair of movable members are independently movable to one another.

9. The walking assistance device according to claim 6, wherein the elastic member is provided between the lower end portion of the movable member and a rear end portion of the supporting member so that the lower end portion of the movable member is pulled rearward by the elastic member.

10. The walking assistance device according to claim 8, wherein each of the movable members includes a rotation center portion configured to be rotatably supported on one of distal end portions of the bifurcated portion, a rear wall portion extending from the rotation center portion along a rear surface of the bifurcated portion, and a projecting portion configured to extend forward from the rotation center portion, and wherein each of the elastic members is provided between the projecting portion and the supporting member so that the projecting portion is pulled downward by the elastic member.

* * * * *